United States Patent [19]

Landow

[11] 4,254,316

[45] Mar. 3, 1981

[54] ELECTRICAL SWITCHING APPARATUS

[75] Inventor: Walter Landow, Highland Heights, Ohio

[73] Assignee: Clark Control, Inc., Cleveland, Ohio

[21] Appl. No.: 71,228

[22] Filed: Aug. 30, 1979

[51] Int. Cl.[3] ..... H01H 9/08; H01H 9/18; H01H 51/00

[52] U.S. Cl. ..... 200/308; 200/DIG. 47; 335/17; 335/132

[58] Field of Search ..... 335/17, 132; 200/308, 200/DIG. 47, 310, 309; 116/202, DIG. 5, DIG. 26

[56] References Cited

U.S. PATENT DOCUMENTS

| | | | |
|---|---|---|---|
| 3,437,773 | 4/1969 | Koertge | 335/132 |
| 3,501,717 | 3/1970 | Schubring et al. | 200/308 |
| 3,724,922 | 4/1973 | Jones | 350/96.26 |
| 3,916,133 | 10/1975 | Bollinger | 200/308 |
| 4,087,770 | 5/1978 | Kuhn et al. | 335/132 |
| 4,117,428 | 9/1978 | Streich et al. | 335/132 |
| 4,117,429 | 9/1978 | Streich et al. | 335/132 |
| 4,156,149 | 5/1979 | Vaccuri | 250/577 |

*Primary Examiner*—John W. Shepperd

*Attorney, Agent, or Firm*—David M. Keay

[57] ABSTRACT

Electromagnetically operated contactor or relay employing contact modules which are removably mounted in either of two positions respectively providing normally open and normally closed contact conditions. One set of contact modules is mounted in a main frame and a second set is mounted in an upper frame which overlies the main frame and obscures the first set of contact modules. Transparent viewing members extend through apertures in the upper frame. Each transparent viewing member has a viewing surface exposed externally of the upper frame and an image transmitting surface adjacent to a contact module of the underlying first set. Each contact module has two light reflecting surface areas which are distinguishable from each other, one or the other being adjacent to the image transmitting surface of the associated transparent viewing member depending upon the position of the contact module. Thus, the images of the light reflecting surface areas appearing at the viewing surfaces of the transparent viewing members provide visual indications of the positions and consequently the normal contact conditions of the underlying contact modules.

12 Claims, 8 Drawing Figures

ELECTRICAL SWITCHING APPARATUS

CROSS-REFERENCE TO RELATED APPLICATIONS

The subject matter of this application is related to the subject matter disclosed in application Ser. No. 933,320 now U.S. Pat. No. 4,184,134 filed Aug. 14, 1978 by Hugh Kane and Bruce A. Oellerich entitled "Electrical Switching Apparatus" and application Ser. No. 050,000 filed June 18, 1979 entitled "Electromagnetic Switching Apparatus," both applications being assigned to the assignee of the present application.

BACKGROUND OF THE INVENTION

This invention relates to electrical switching apparatus. More particularly, it is concerned with electromagnetically operated switching apparatus employing convertible contact modules which operate in either a normally open or a normally closed condition depending upon their mounting position.

Electrical switching apparatus such as electromagnetic contactors or relays for opening and closing a plurality of switches are well-known. In order to provide versitility contactors of this general type frequently employ switch or contact modules which selectively may be changed to function in either the normally open or normally closed condition. Certain contactors are designed to employ convertible contact modules which when placed in the contactor in one position provide a normally open switch and when removed and replaced in a different position, typically inverted, provide a normally closed switch.

It is desirable to be able to determine by visual observation the mounting positions and consequently the contact conditions of each of the convertible contact modules. Each convertible contact module generally contains indicia in the form of symbols and/or color coding to provide visual indication at a glance as to the position of the convertible contact module. Direct viewing of the indicia on the convertible contact modules may be difficult, however, if a cover or other portion of the apparatus obscures the contact modules. Viewing of the indicia is even more difficult with contactors employing two sets of convertible contact modules with a first set at a lower level and a second set at a second level overlying and obscuring the first set. Contactors of this general type are shown and described in the aforementioned applications.

SUMMARY OF THE INVENTION

Visual observation permitting determination of contact conditions of otherwise obscured convertible contact modules is provided with electrical switching apparatus in accordance with the present invention. The electrical switching apparatus includes a supporting structure and a convertible contact module having first and second contact terminals on its exterior which is removably mounted in the supporting structure. The convertible contact module may be mounted in either of two positions respectively providing normally open and normally closed contact conditions between the contact terminals. A housing member which is removably mounted on the supporting structure overlies the convertible contact module. The housing member has an aperture in which a transparent viewing member is mounted. The transparent viewing member has a viewing surface which is exposed externally of the housing member and an image transmitting surface which is disposed closely adjacent to the convertible contact module mounted in the supporting structure. The convertible contact module has a first light reflecting surface area which is located closely adjacent to the image transmitting surface and is illuminated by light transmitted through the transparent viewing member from the viewing surface when the convertible contact module is in the first of the two positions. The convertible contact module also has a second light reflecting surface area which is distinguishable from the first light reflecting surface area. The second light reflecting surface area is located closely adjacent the image transmitting surface of the transparent viewing member and is illuminated by light transmitted through the transparent viewing member from the viewing surface when the convertible contact module is in the second of the two positions. Light is transmitted through the transparent viewing member from the viewing surface and the image of the illuminated light reflecting surface area is reflected to the viewing surface. Thus, a visual indication is provided externally of the housing member of the position and consequently of the contact condition of the convertible contact module mounted in the supporting structure.

Figure 1:
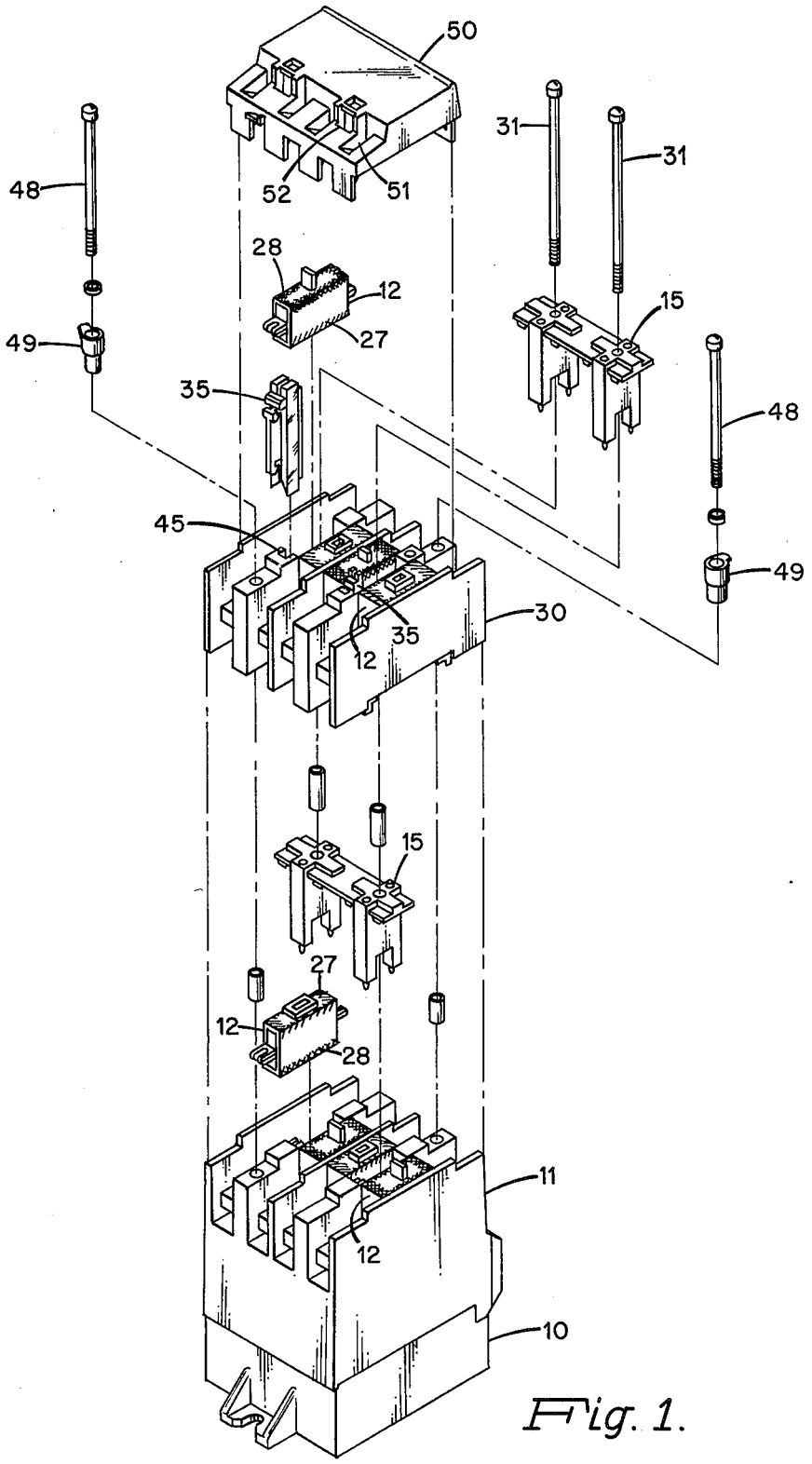
FIG. 1 is an exploded view in perspective of an electromagnetically operated contactor in accordance with the present invention.

For a better understanding of the present invention, together with other and further objects, advantages, and capabilities thereof, reference is made to the following discussion and appended claims in connection with the above described drawings.

DETAILED DESCRIPTION OF THE INVENTION

An electromagnetically operated contactor in accordance with the present invention is illustrated in the figures of the drawing. The apparatus includes a first housing section or base 10 which may be of die-cast zinc containing the stationary elements of the magnetic circuit. A second housing section or main frame 11 of insulating material such as molded thermosetting plastic is attached to the base. The main frame 11 includes compartments capable of supporting four identical switch or contact modules 12. The contact modules are convertible to provide either normally open or normally closed contact conditions depending upon their mounting position. An actuating member 15 and a carrier 16 connected to the magnetic armature are mounted within the main frame 11 in engagement with the contact modules 12 in order to switch them between their normal and opposite contact conditions as the magnetic circuit is energized and deenergized.

Figure 2:
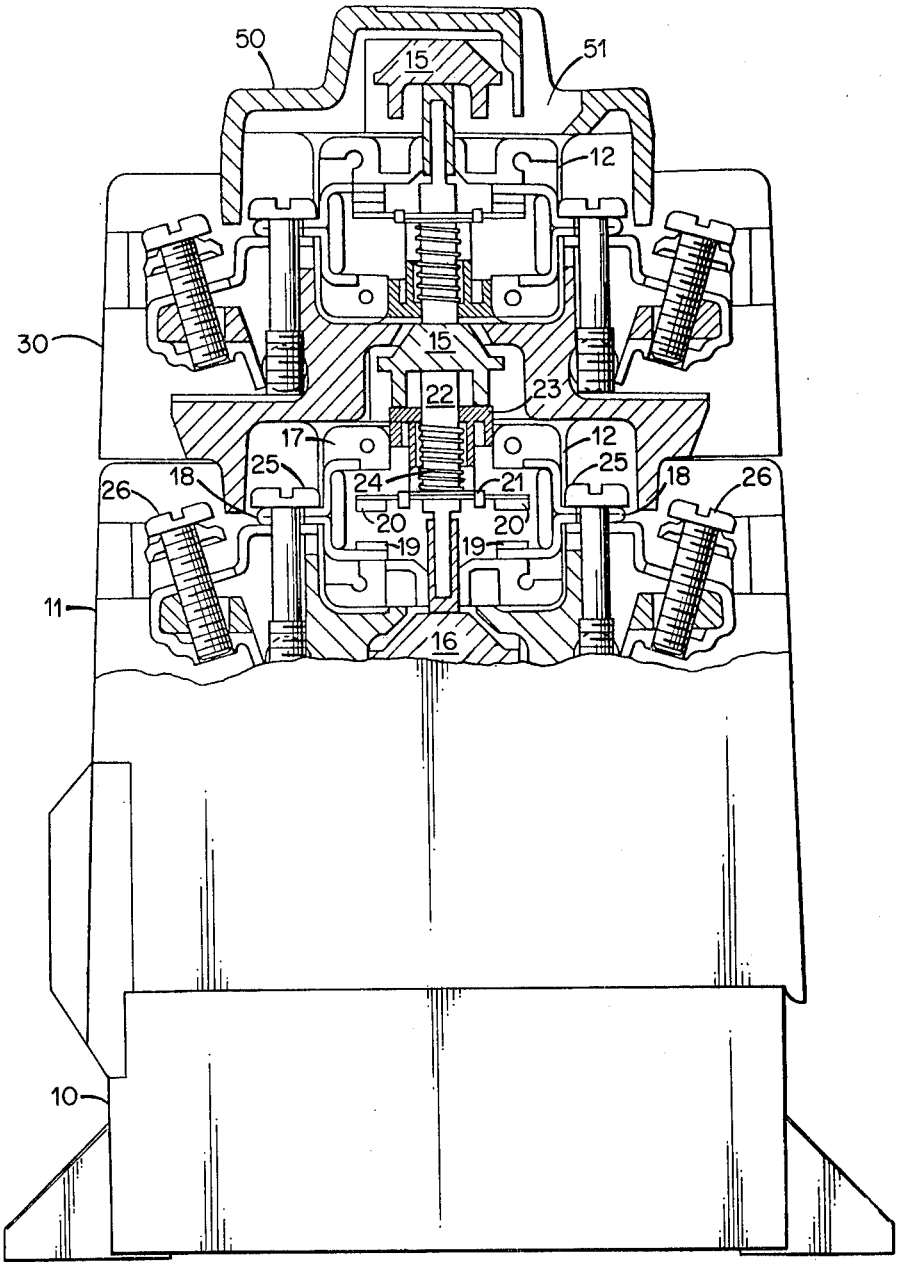
FIG. 2 is an elevational view of the contactor of FIG. 1 partially in cross-section taken generally along the line 2—2 of FIG. 5.

The contact modules 12 are identical. As best seen in FIG. 2 each includes a housing 17 of generally rectangular parallelopiped configuration. Contact terminals 18 extend through the housing from the interior to the exterior of the module housing 17. A pair of stationary contacts 19 are mounted on the inner portions of the terminals 18. A mating pair of movable contacts 20 are carried on a conductive contact bridge 21. The bridge 21 with movable contacts 20 is mounted on a plunger 22 so as to permit limited movement with respect thereto. The plunger 22 is mounted in the housing 17 and protrudes through openings in the top and bottom walls of the module housing so as to permit reciprocating movement. The plunger 22 extends through a central opening in a movable seat 23 which is also mounted in the housing 17 so as to permit reciprocating movement. A compression spring 24 is compressed between the movable seat 23 and the contact bridge 21.

The contact modules 12 are fastened in place in the compartments of the main frame 11, by mounting screws 25, in either one of two inverted positions to provide either normally open or normally closed operation. When the contactor is completely assembled actuating members engage the movable plunger and seat. Movement of the actuating members 15 and carrier 16 in a vertical direction downward as viewed in FIG. 2, in response to energizing of the electromagnet, also moves the plunger 22 and seat 23 of a module positioned in the normally open condition permitting the compression spring 24 to close the contacts. The plunger of a module positioned in the normally closed condition is also moved downward opening the contacts and compressing the compression spring.

In order to provide visual indication of the contact condition of the mounted contact module, portions of the surfaces of the module housing are color coded. The portions of the two side surfaces and the adjoining surface which are uppermost when the module is mounted in the normally open condition are coated with reflective material 27 of one color, for example green. The portions of the two side surfaces and the adjoining surface which are uppermost when the module is mounted in the normally closed condition are coated with a reflective material 28 of a second color clearly distinguishable from the one color, for example yellow. Indicia such as standard symbols designating normally open and normally closed contact conditions may also be placed on the respective surface which is uppermost when the module is mounted in the apparatus.

Switching apparatus in accordance with the present invention includes a third housing section or upper frame 30 having compartments for mounting four contact modules 12. Each of the contact modules is identical to and interchangeable with the contact modules 12 in the main frame 11. The contact modules are mounted in the frames by mounting screws 25 and electrical connections are made thereto at wiring terminals 26 as explained in detail in the aforementioned application of Kane and Oellerich. An actuating member 15 positioned in the upper frame 30 and the actuating member 15 mounted within the main frame 11 engage the contact modules 12 and switch them between contact conditions as the magnetic circuit is energized and deenergized. The two actuating members 15 are fastened to the carrier 16 by through-bolts 31.

The upper frame 30 has apertures extending vertically therethrough in the regions of the upper frame between each pair of contact modules. (See FIGS. 3 and 4.) Mounted within each aperture is a pair of transparent viewing members 35 of transparent plastic material, for example trogimid. As will be apparent from the following discussion the viewing members 35 are optical indicators providing views of portions of the reflective material 27 or 28 on the underlying contact modules in the main frame 11 so that their normal contact conditions are readily determined.

Figure 3:
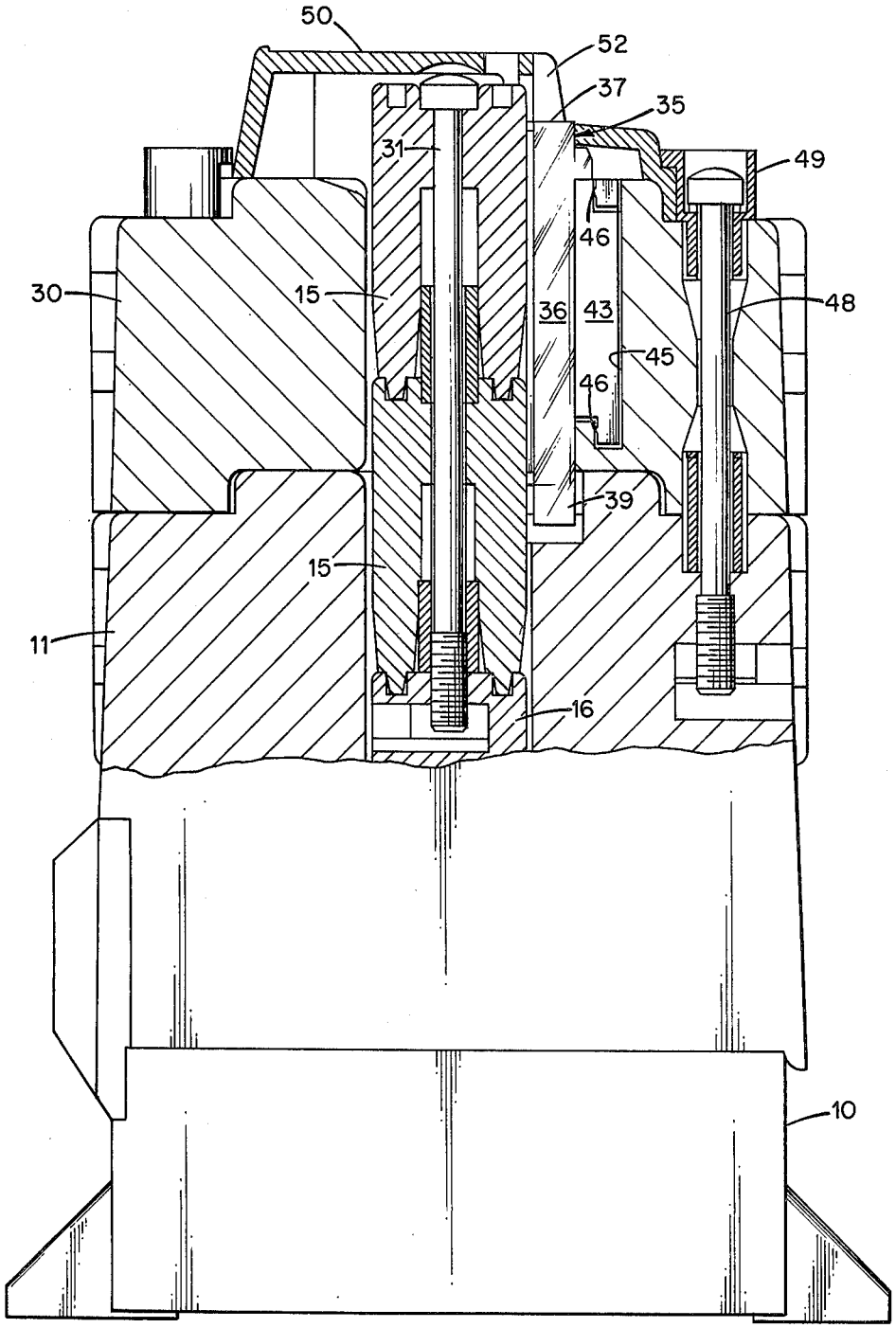
FIG. 3 is an elevational view of the contactor partially in cross-section taken generally along the line 3—3 of FIG. 5.
Figure 4:
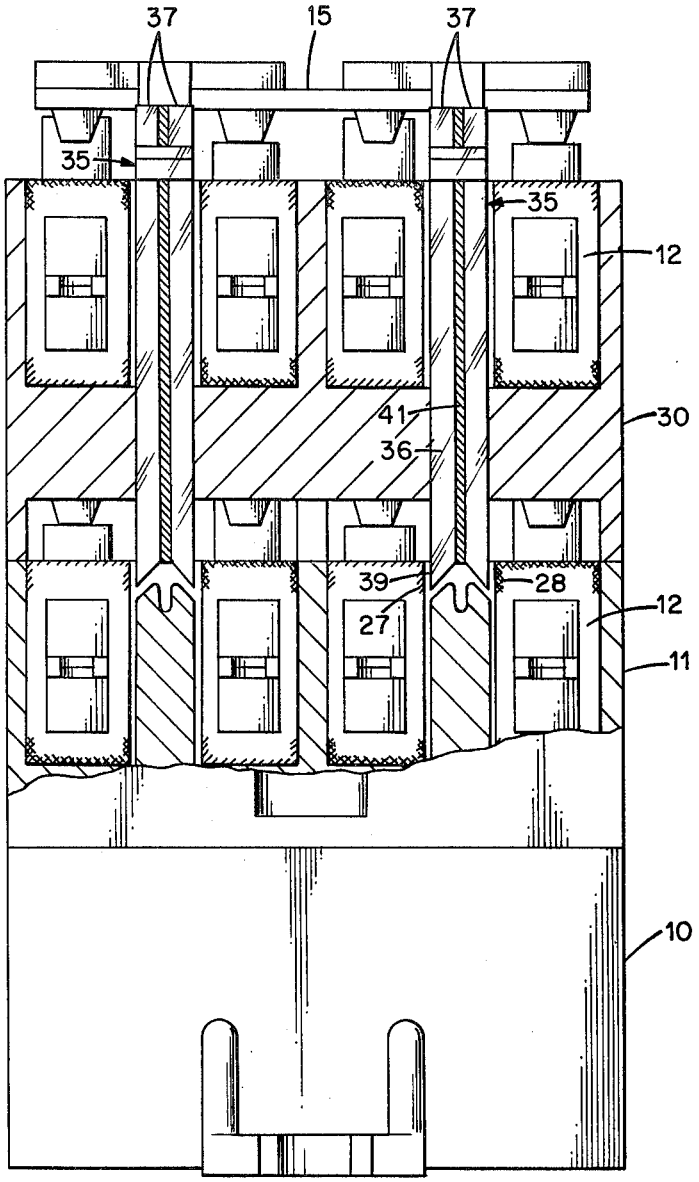
FIG. 4 is an elevational view of the contactor with the cover removed partially in cross-section taken generally along the line 4—4 of FIG. 6.
Figure 5:
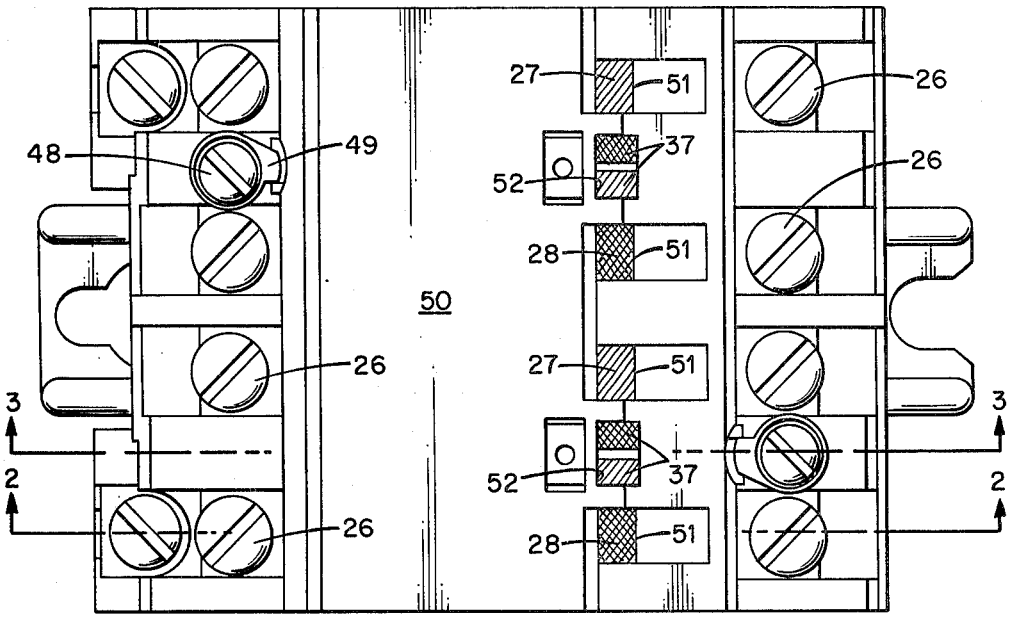
FIG. 5 is a plan view of the contactor.
Figure 6:
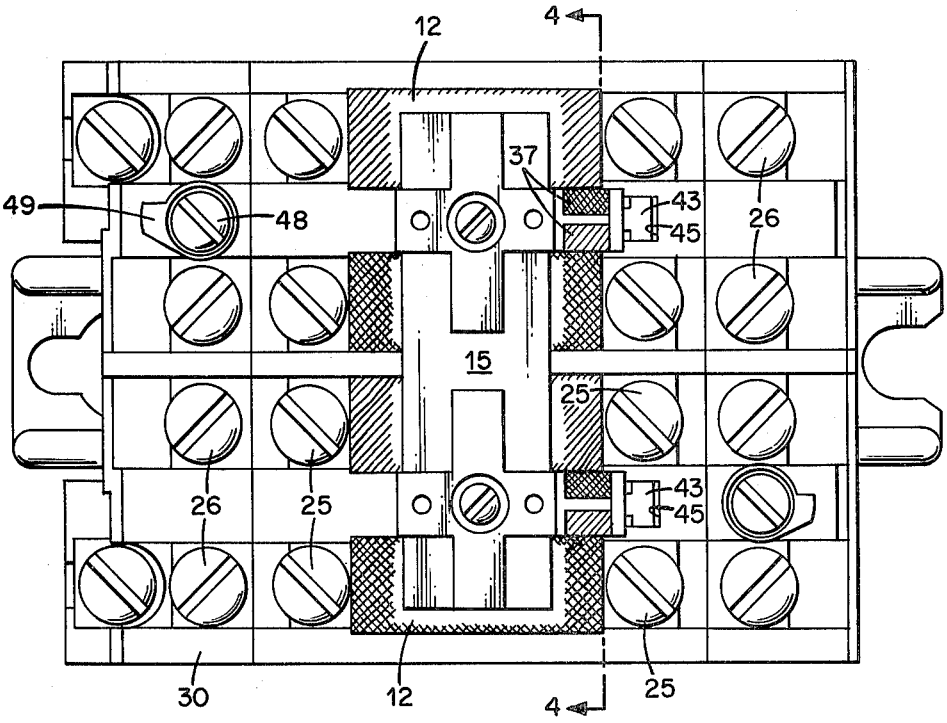
FIG. 6 is a plan view of the contactor with the cover removed.
Figure 7A:
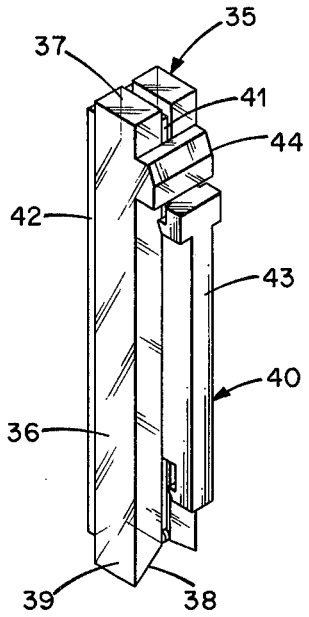
FIGS. 7A and 7B are perspective views of an assembled and disassembled viewing member employed in the contactor.
Figure 7B:
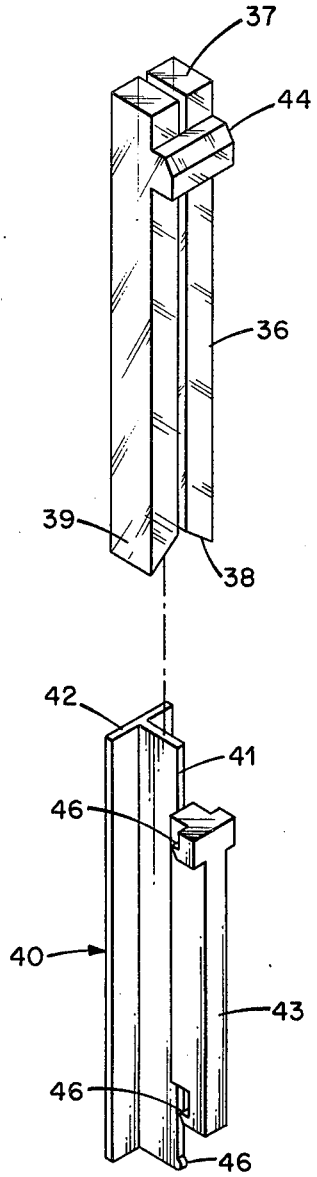

As shown in FIGS. 7A and 7B in addition to FIGS. 3 and 4 each of the viewing members 35 is an elongated member 36 of generally rectangular corss-section and has a viewing surface 37 normal to its major axis at its upper end. The opposite end of the elongated member has a surface 38 at a 45° angle with respect to the major axis. This angle provides an internal reflecting surface and produces an image transmitting surface 39 at the side of the elongated member 36. In the assembled contactor the image transmitting surface 39 of each viewing member lies closely adjacent to the reflective material 27 or 28 disposed on the upper portion of one of the side surfaces of the associated contact module. As is well understood light passing down the elongated member 36 from the viewing surface 37 strikes the reflective material 27 or 28 of its associated contact module illuminating it. The image of that portion of the reflective material is transmitted up through the elongated member to the viewing surface 37. Thus the colored image at the viewing surface 37 is a visual indication of the normal contact condition of the associated contact module 12 below.

The transparent elongated members of a pair of viewing members are supported in a holder 40 which is of opaque plastic material. The holder has a septum 41 extending between the two adjacent sides of the pair of elongated members 36. A thin section 42 of plastic material which is attached along one edge of the septum 41 overlies a side of each of the two viewing members. An arm 43 which is slightly wider than the septum extends along its other edge in the direction of the major axis. A bar 44 fixed to sides of the elongated members of each pair holds the pair of members 36 together. The two elongated members 36 are confined between the arm 43 and the thin section 42 of the holder with the septum 41 between them. The arm 43 fits in a recess 45 in the upper frame adjacent to the aperture therethrough. Protrusions 46 on the arm 43 and septum 41 engage surfaces of the upper frame 30 adjacent to the recess 45 thus firmly holding the viewing members 35 in the aperture.

A cover 50 is positioned on the upper frame 30 covering the upper level of contact modules 12. Bolts 48 which pass through the upper frame 30 adjacent to the cover fasten the upper frame to the main frame 11. The bolts also pass through hold-down members 49 having tabs which engage shoulders on the cover 50 for holding it in place. The cover 50 has two sets of openings 51 and 52 therethrough arranged in a line. One set of four openings 51 exposes the reflective material 27 or 28 on portions of the upper surfaces of the four contact modules in the upper frame 30 permitting visual observation thereof and thus determination of their normal contact conditions. Between each pair of openings 51 of the first set exposing a pair of contact modules in the upper level is a single opening 52 of the second set exposing the viewing surfaces 37 of a pair of viewing members 35. Visual indications of the normal contact conditions of the contact modules at both the upper level and the lower level appear along a line at roughly the same level. The major portions of the four elongated sides of each viewing member 35 are closely confined by the combination of the septum 41 and thin section 42 of the holder 40, the surfaces of the upper frame 30 defining the aperture, the side of the adjacent contact module 12, and the surfaces surrounding the second opening 52 in the cover 50.

Thus, with the contactor as described the normal contact conditions of all contact modules may be ascertained quickly and easily without disturbing the contactor or its operation. The manner in which selected contact modules may be removed, inverted, and replaced so as to convert their normal contact conditions is described in the aforementioned application of Kane and Oellerich.

While there has been shown and described what is considered a preferred embodiment of the present invention, it will be obvious to those skilled in the art that various changes and modifications may be made therein without departing from the invention as defined by the appended claims.

What is claimed is:

1. Electrical switching apparatus including supporting structure;

a convertible contact module having first and second contact terminals on the exterior thereof, said convertible contact module being removably mounted in said supporting structure in either of two positions respectively providing normally open and normally closed contact conditions between its contact terminals;

a housing member removably mounted on said supporting structure and overlying said convertible contact module mounted in said supporting structure, said housing member having an aperture therethrough;

a transparent viewing member mounted in said housing member and extending through said aperture, said transparent viewing member having a viewing surface exposed externally of the housing member and an image transmitting surface disposed closely adjacent to said convertible contact module mounted in said supporting structure;

said convertible contact module having a first light reflecting surface area located closely adjacent to said image transmitting surface of the transparent viewing member and being illuminated by light transmitted through the transparent viewing member from the viewing surface thereof when the convertible contact module is in the first of said two positions; and said convertible contact module having a second light reflecting surface area distinguishable from said first light reflecting surface area, said second light reflecting surface area being located closely adjacent to said image transmitting surface of the transparent viewing member and being illuminated by light transmitted through the transparent viewing member from the viewing surface thereof when the convertible contact module is in the second of said two positions;

whereby light is transmitted through the transparent viewing member from the viewing surface thereof and the image of the illuminated light reflecting surface area is reflected to the viewing surface thereby providing a visual indication externally of the housing member of the position and consequently the contact conditions of the convertible contact module mounted in the supporting structure.

2. Electrical switching apparatus in accordance with claim 1 wherein said housing member includes means for removably supporting a convertible contact module;

and including a convertible contact module identical to said first-mentioned convertible contact module and removably mounted in said housing member in either of two positions respectively providing normally open and normally closed contact conditions between its contact terminals;

a cover removably mounted on said housing member and overlying the convertible contact module mounted therein, said cover having a first opening therethrough exposing the viewing surface of the transparent viewing member and having a second opening therethrough exposing a portion of the surface of the convertible contact module mounted in said housing member;

each of said convertible contact modules having a first portion of its surface exposed through the second opening in said cover when the convertible contact module is mounted in the housing member in the first of said two positions; and each of said convertible contact modules having a second portion of its surface distinguishable from said first portion exposed through the second opening in said cover when the convertible contact module is mounted in the housing member in the second of said two positions; whereby a visual indication of the contact condition of the convertible contact module mounted in the supporting structure is provided at said first opening in the cover and a visual indication of the contact condition of the convertible contact module mounted in the housing member is provided at said second opening in the cover.

3. Electrical switching apparatus in accordance with claim 2 wherein said convertible contact module mounted in the housing member directly overlies the convertible contact module mounted in the supporting structure;

said transparent viewing member is an elongated member having the viewing surface at one end and the image transmitting surface at the other end, said elongated member having a surface at an angle of 45° to its major axis at said other end to provide an internal light reflecting surface establishing the image transmitting surface at a side of the elongated member parallel to its major axis;

said convertible contact module mounted in the supporting structure has side surfaces disposed generally parallel to the major axis of the transparent viewing member;

said first light reflecting surface area on the convertible contact module mounted in the supporting structure is located at a side surface of the convertible contact module disposed generally parallel to the major axis of the transparent viewing member; and said second light reflecting surface area on the convertible contact module mounted in the supporting structure is located at a side surface of the convertible contact module disposed generally parallel to the major axis of the transparent viewing member.

4. Electrical switching apparatus in accordance with claim 3 wherein the first and second openings in the cover are located in side-by-side relationship with an image of a light reflecting surface area on the side of the convertible contact module mounted in the supporting structure appearing at the viewing surface through the first opening and with a portion of the surface of the convertible contact module mounted in the housing member appearing at the second opening.

5. Electrical switching apparatus in accordance with claim 4 including a holding member for supporting the transparent viewing member, said holding member having an arm extending along the direction of the major axis of the transparent viewing member;

said housing member having a recess therein adjacent to said aperture for accommodating the arm of the holding member with the transparent viewing member extending through the aperture; and cooperating engagement means on said arm and on the housing member for securing the holding member and the transparent viewing member supported thereby in the housing member.

6. Electrical switching apparatus including supporting structure;

a first set of identical convertible contact modules arranged in pairs, each convertible contact module having first and second terminals on the exterior thereof and being removably mounted in said supporting structure in either of two positions respectively providing normally open and normally closed contact conditions between its contact terminals;

a housing member removably mounted on said supporting structure and overlying said first set of convertible contact modules mounted in the supporting structure;

a second set of identical convertible contact modules arranged in pairs, each convertible contact module being identical to the convertible contact modules of the first set, the convertible contact modules of the second set each being removably mounted in said housing member directly overlying a convertible contact module of the first set in either of two positions respectively providing normally open and normally closed contact positions between its contact terminals;

said housing member having apertures therethrough, each located between the convertible contact modules of a pair of convertible contact modules of the set set mounted in the housing member;

a pair of transparent viewing members associated with each pair of convertible contact modules mounted in the supporting structure, a pair of transparent viewing members being mounted in each of said apertures of the housing member and extending therethrough, each of said viewing members having a viewing surface exposed externally of the housing member and an image transmitting surface disposed closely adjacent to one of the convertible contact modules of the associated pair of convertible contact modules mounted in said supporting structure;

each convertible contact module having a first light reflecting surface area located closely adjacent to said image transmitting surface of a transparent viewing member and being illuminated by light transmitted through the transparent viewing member from the viewing surface thereof when the convertible contact module is mounted in the supporting structure in the first of said two positions; and each convertible contact module having a second light reflecting surface area distinguishable from said first light reflecting surface area, said second light reflecting surface area being located closely adjacent to said image transmitting surface of the transparent viewing member and being illuminated by light transmitted through the transparent viewing member from the viewing surface thereof when the convertible contact module is mounted in the supporting structure in the second of said two positions;

whereby light is transmitted through each transparent viewing member from the viewing surface thereof and the image of the illuminated light reflecting surface area is reflected to the viewing surface thereof thereby providing visual indication externally of the housing member of the positions and consequently the contact conditions of each of the convertible contact modules mounted in the supporting structure.

7. Electrical switching apparatus in accordance with claim 6 including a cover removably mounted on said housing member and overlying the second set of convertible contact modules mounted therein, said cover having a first set of openings therethrough exposing the viewing surfaces of the transparent viewing members and having a second set of openings therethrough exposing a portion of the surface of each of the convertible contact modules mounted in said housing member;

each convertible contact module having a first portion of its surface exposed through an opening of the second set of openings in said cover when the convertible contact module is mounted in the housing member in the first of said two positions; and each convertible contact module having a second portion of its surface distinguishable from said first portion exposed through an opening of the second set of openings in said cover when the convertible contact module is mounted in the housing member in the second of said two positions;

whereby visual indications of the contact conditions of the covertible contact modules mounted in the supporting structure are provided at said first set of openings in the cover and visual indications of the contact conditions of the convertible contact modules mounted in the housing member are provided at said second set of openings in the cover.

8. Electrical switching apparatus in accordance with claim 7 wherein each of said transparent viewing members is an elongated member having the viewing surface at one end and the image transmitting surface at the other end, said elongated member having a surface at an angle of 45° to its major axis at said other end to provide an internal light reflecting surface establishing the image transmitting surface at a side of the elongated member parallel to its major axis;

each of said convertible contact modules mounted in the supporting structure has side surfaces disposed generally parallel to the major axis of the transparent viewing members;

said first light reflecting surface area on each convertible contact module mounted in the supporting structure is located at a side surface of the convertible contact module disposed generally parallel to the major axis of the transparent viewing member; and said second light reflecting surface area on each convertible contact module mounted in the supporting structure is located at a side surface of the convertible contact module disposed generally parallel to the major axis of the transparent viewing member.

9. Electrical switching apparatus in accordance with claim 8 wherein said openings of the first and second sets of openings in the cover are located generally along a line with a portion of the surface of the convertible contact modules of each pair of convertible contact modules mounted in the housing member appearing at a pair of openings of the second set of openings and with an image of a light reflecting surface area on the side of each convertible contact module of each pair of convertible contact modules mounted in the supporting structure appearing at the viewing surfaces of the associated pair of transparent viewing members through an opening of the first set of openings located between the two openings of a pair of openings of the second set.

10. Electrical switching apparatus in accordance with claim 9 including a holding member for supporting each pair of transparent viewing members, each holding member having an arm extending along the direction of the major axis of the transparent viewing members;

said housing member having a recess therein adjacent to each of said apertures for accommodating the arm of a holding member with the transparent viewing members extending through the aperture; and cooperating engagement means on each of said arms and on the housing member for securing each of the holding members and the transparent viewing members supported thereby in the housing member.

11. Electrical switching apparatus in accordance with claim 10 wherein each of said transparent viewing members is rectangular in cross-section normal to its major axis and has four elongated sides;

each of said holding members is of opaque material and includes a septum extending between the adjacent sides of the two transparent viewing members of the pair and a thin section adjoining the septum along one edge thereof and overlying a side of each of the two transparent viewing members of the pair;

said arm adjoins the septum along a portion of the opposite edge thereof;

said septum and said thin section of the holding member, the surfaces of the housing member defining the aperture, the side of the adjacent convertible contact module mounted in the housing member, and the surfaces of the cover surrounding the second opening therein, in combination, closely confines the four elongated sides of each transparent viewing member.

12. Electrical switching apparatus in accordance with claim 11 including a bar fixed to the two transparent viewing members of each pair at the sides opposite from the sides adjacent to said thin section of the holding member and located adjacent to the viewing surfaces for holding the two transparent viewing members in fixed position with respect to each other;

said arm of the holding member being wider than the thickness of said septum to confine the two transparent viewing members of the pair in the holding member.

* * * * *